US009656830B2

(12) United States Patent
Barea

(10) Patent No.: US 9,656,830 B2
(45) Date of Patent: May 23, 2017

(54) YARN RECOVERY DEVICE AND YARN FEED SYSTEM COMPRISING SAID DEVICE

(71) Applicant: BTSR INTERNATIONAL S.P.A., Olgiate Olona (Varese) (IT)

(72) Inventor: Tiziano Barea, Busto Arsizio (IT)

(73) Assignee: BTSR INTERNATIONAL S.P.A., Olgiate Olona (Varese) (IT)

( * ) Notice: Subject to any disclaimer, the term of this patent is extended or adjusted under 35 U.S.C. 154(b) by 49 days.

(21) Appl. No.: 14/893,251

(22) PCT Filed: Jun. 9, 2014

(86) PCT No.: PCT/IB2014/062071
§ 371 (c)(1),
(2) Date: Nov. 23, 2015

(87) PCT Pub. No.: WO2014/199281
PCT Pub. Date: Dec. 18, 2014

(65) Prior Publication Data

US 2016/0096703 A1 Apr. 7, 2016

(30) Foreign Application Priority Data

Jun. 10, 2013 (IT) ..... MI2013A0948

(51) Int. Cl.
*B65H 51/22* (2006.01)
*B65H 51/20* (2006.01)
(Continued)

(52) U.S. Cl.
CPC ..... *B65H 51/22* (2013.01); *B65H 51/20* (2013.01); *B65H 59/18* (2013.01); *B65H 59/26* (2013.01);
(Continued)

(58) Field of Classification Search
CPC ..... B65H 51/20; B65H 51/22; B65H 59/18; B65H 59/26; D04B 15/482; D05B 59/00
See application file for complete search history.

(56) References Cited

U.S. PATENT DOCUMENTS

2005/0224619 A1 10/2005 Barea
2007/0018027 A1 1/2007 Castelli et al.

FOREIGN PATENT DOCUMENTS

CH 685712 A5 9/1995
DE 19924379 A1 10/2000
(Continued)

OTHER PUBLICATIONS

International Search Report and Written Opinion mailed Aug. 20, 2014 for PCT/IB2014/062071 to BTSR International S.P.A. filed Jun. 9, 2014.

*Primary Examiner* — William E Dondero
(74) *Attorney, Agent, or Firm* — Vorys, Sater, Seymour and Pease LLP

(57) ABSTRACT

A yarn recovery device includes a support structure that can be associated upstream or downstream with a yarn feed device, a yarn entry eye and exit eye rigidly connected to the support structure; a drum rotatably associated with the support structure having a seat to accommodate the yarn operationally located between the entry eye and the exit eye; the drum being switchable between a deactivated configuration, in which the seat is substantially aligned with the entry eye and the exit eye and the path of the yarn is not diverted by the drum, and an activated configuration, in which the seat is misaligned in relation to the entry eye and the exit eye and the path of the yarn is diverted by the drum that winds the yarn round itself.

15 Claims, 4 Drawing Sheets

(51) Int. Cl.

| | |
|---|---|
| ***B65H 59/26*** | (2006.01) |
| ***D04B 15/48*** | (2006.01) |
| ***B65H 59/18*** | (2006.01) |

(52) U.S. Cl.
CPC ..... *D04B 15/482* (2013.01); *B65H 2701/31* (2013.01)

(56) References Cited

FOREIGN PATENT DOCUMENTS

| | | |
|---|---|---|
| EP | 1741817 A1 | 1/2007 |
| EP | 1501970 B1 | 6/2011 |

YARN RECOVERY DEVICE AND YARN FEED SYSTEM COMPRISING SAID DEVICE

CROSS-REFERENCE TO RELATED APPLICATIONS

This is a §371 National Stage Application of International Application No. PCT/IB2014/062071 filed on Jun. 9, 2014, claiming the priority of Italian Patent Application No. MI2013A000948 filed on Jun. 10, 2013.

This invention relates to a yarn recovery device and a yarn feed system that incorporates said device.

This invention is used in feeding yarns of natural or artificial textile fibres to textile machines.

The invention described may also be advantageously used in feeding metal wires.

The yarn is fed by means of feed devices that comprise a drum onto which the yarn, coming from a bobbin upstream, is partly wound. The drum, made to rotate by a motor, unwinds the yarn towards the textile machine downstream and, at the same time, winds the yarn coming from the bobbin.

The aim of known feed devices is to supply the textile machine with the yarn at a constant tension as the operating conditions of the machine and, therefore, the speed at which the yarn is required vary. To this end, a sensor located downstream of the drum measures the tension of the yarn sent to the machine. The operation and speed of the drum are adjusted depending on the measured and the desired tension.

For example, if the speed at which the yarn is required by the machine drops, the device automatically reduces the speed of rotation of the drum, even reversing the direction of rotation thereof during a machine downtime phase or during a phase in which the machine returns the yarn to the feeder. In the case of small-to-medium diameter circular machines we are speaking of reciprocated motion. This is done in order to keep the tension constant throughout the entire process. A feed device of this type is described in EP1501970B1.

During these phases of reversal of the direction of rotation of the drums, upstream of the drum an excess of yarn is thus created which can wind round itself creating knots or breaks when the textile machine restarts.

In this regard, particularly when the quantity of yarn to be recovered is considerable and/or it is not possible to make use of the elasticity of the yarn, a yarn recovery device is often connected upstream of the feed device in order to recover the resulting excess yarn, preventing mishaps or damage.

Known recovery devices can be of a mechanical type. For example, they have a yarn brake at the entry and a recovery arm connected at a first end to a spring and to a ring in which the yarn is made to pass through at a second end. The spring continuously exerts a force on said arm to divert the trajectory of the yarn and thus generate a stock of yarn upstream of the feed device.

Examples of these devices can be seen in publications DE 199 24 379, EP 1 741 817 and CH 685 712.

During the phase of feeding the yarn to the textile machine, the motor that turns the drum must overcome the force of the spring in order to discharge the stock. Vice versa, during the recovery phase, the spring diverts the trajectory of the yarn filling the stock, while the drum picks up yarn from the machine.

The limitation of this type of solution clearly lies in the critical nature of the spring's adjustment.

In particular, the force of the spring that controls the recovery arm must be adjusted so that it can be overcome during the feed phase in order to discharge the stock, but must have the necessary energy to recover the yarn during the reversal phase in order to load the stock without missing slackening thereof which, in addition to loops and knots, would result in a loss of grip (slipping) of the yarn on the drum that would consequently be unable to control the feed/recovery of the yarn.

Furthermore, the yarn brake at the entry must be adjusted so that during the work phase of the recovery arm, the yarn is in fact taken from the drum and not from the entry bobbin. It must therefore exert a greater force on the yarn than that exerted by the spring in the recovery phase.

Lastly, note that the force of the yarn brake and recovery spring depend on the tension at which the yarn is fed and recovered.

Another problem caused by the above-described solution is the accumulation of pre-tensions exerted on the yarn before arriving at the feeder. These tensions must be overcome by the motor during the normal feed phase and consequently they limit its dynamics, particularly during the acceleration phase. Obviously, this reduction in dynamics can cause a peak of tension on exiting, which compromises the quality of the finished product, or can cause the yarn to break.

Excessive tensioning of the yarn on entry can cause deterioration of the typical characteristics of the fed yarn (number of twists, covering, etc.) or, in the case of thin yarns, bring them close to their breaking point. In other embodiments, the recovery device is of a pneumatic type. In this case, the yarn is diverted by means of a flow of air blown or aspirated against the yarn. In this type of recovery device too a brake is required upstream to ensure that the yarn is not recovered by the bobbin but by the feed device.

This type of recovery limits the problem of the tension on entry into the feed device, but involves using a compressed air circuit not always present on textile machines. It cannot therefore always be used and is certainly more expensive in terms of energy.

Another drawback of known solutions (whether using a spring or air) is the limitation of the quantity of yarn that can be recovered by the device, which is directly proportional to its size.

In this context, the technical task at the heart of the present invention is to propose a yarn recovery device and a yarn feed system that incorporates this device that overcomes the drawbacks of the above-mentioned state of the art.

In particular, the aim of the present invention is to provide a yarn recovery device and a yarn feed system that incorporates this device that allows a more efficient recovery of the yarn in the case of constant-tension feed, without the need for significant pre-tensioning upstream.

Another aim of the present invention is to provide a yarn recovery device and a yarn feed system that incorporates this device and is capable of working with the same setting at different tensions.

Another aim is to have a compact recovery system capable of recovering an unlimited quantity of yarn.

The specified technical task and the specified aim are substantially achieved by a yarn recovery device and a yarn feed system that incorporates this device having the technical characteristics described in one or more of the accompanying claims.

Further characteristics and advantages of this invention will emerge more clearly from the description, given purely by way of a non-limiting example, of a preferred but not exclusive embodiment of a yarn recovery device and yarn feed system that incorporates said device, as illustrated in the accompanying drawings, in which.

Figure 1:
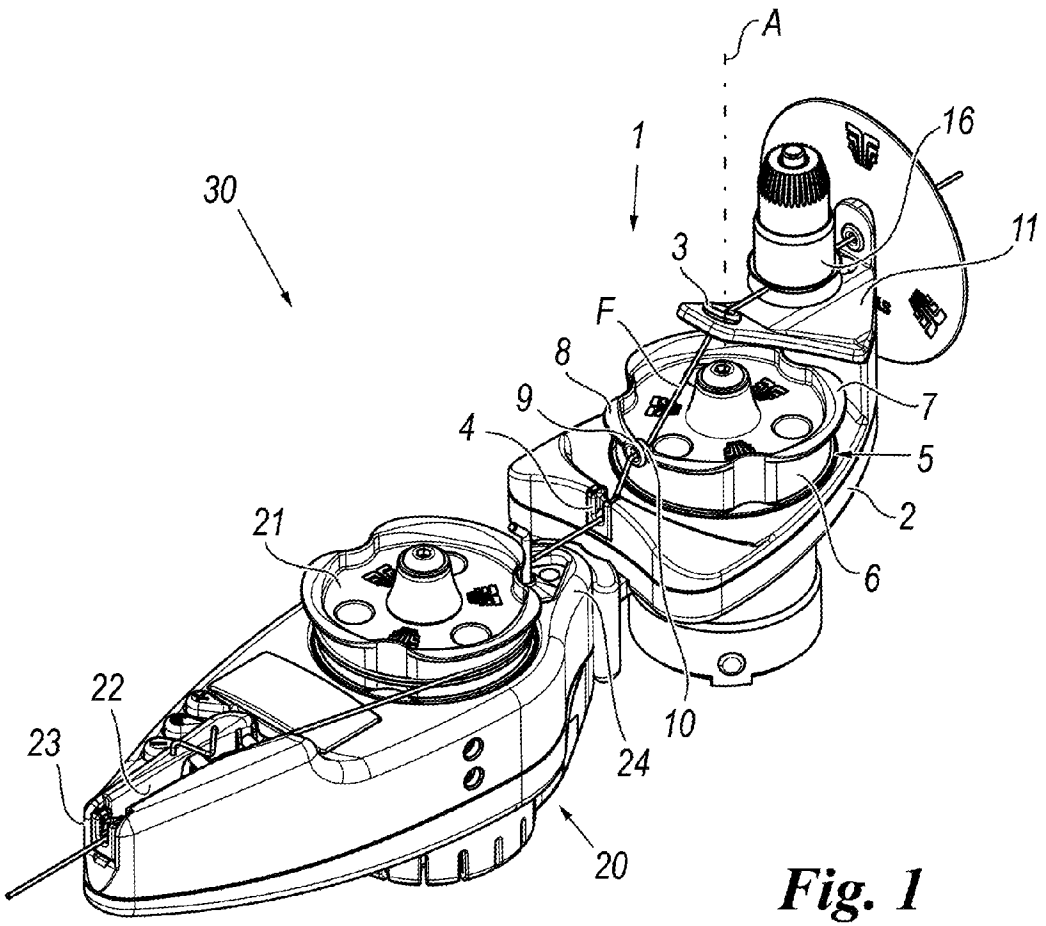
FIG. 1 is a perspective view of a yarn recovery device and feed system according to the present invention in a first operating configuration.

With reference to the accompanying Figures, 1 indicates as a whole a yarn recovery device according to the present invention.

As will become clearer below, the device 1 can be associated with a feed device 20 of the yarn "F" to a textile machine, thus forming a feed device 30 of the yarn "F" in accordance with another aspect of the present invention.

Advantageously, the recovery device 1 enables the yarn to be recovered near the feed device 2 whenever the production process of the textile machine so requires.

In a preferred embodiment, the recovery device 1 is operationally associated upstream of the feed device 20. In this case, the feed device 20 is of a constant tension type.

The feed device 20 comprises a drum 21 onto which the yarn "F" is wound and a motor 26 connected to the drum 21.

The rotation of the drum 21, by the motor 26, allows the yarn "F" downstream of the drum 21 to be unwound towards the textile machine and more yarn "F" to be wound onto the drum 21 from the bobbin upstream.

This case describes a "positive-action" feeder, in that it supplies the yarn "F" to suit the operating phases of the textile machine.

The feed device 20 also comprises a tension sensor 22 located at an exit 23 of the feed device 20.

The tension sensor 22 generates a tension signal "ST" representative of the measurement of the value of tension acting on the yarn "F".

A processing unit 25 is connected to the tension sensor 22 to receive the tension signal "ST". The measured tension value is compared, by the processing unit 25, to a reference value set by the user on the basis, for example, of the type of yarn "F" used and the type of working.

The processing unit 25, after comparing the measured tension value with the reference value, generates a compensation signal "SC" representative of the variation in angular speed to be set on the drum 21 in order to compensate for the variation in tension until the reference tension value is restored.

More precisely, the angular speed of the drum 21 decreases and increases as a function of the measured tension value. In particular, during the machine stopping or down time, this speed is cancelled out or actually reversed, always with the aim of continuing to keep the tension constant.

In this case, during the reversal of the speed of rotation of the drum 21, the latter unwinds part of the yarn upstream at an entry 24 of the feed device 20. This yarn is recovered by the recovery device 1.

In other words, the feed device 20 performs a first recovery of an excess of yarn "F" that is formed upstream of the textile machine. The recovery device 1 performs a second recovery of the excess yarn "F" recovered from the feed device 20 and created upstream of the said feed device 20.

The recovery device 1 comprises a support structure 2 that can be associated upstream of the feed device 20. In other words, the recovery device 1 is arranged between a bobbin (not shown) on which the yarn "F" to be fed is wound and the feed device 20, in particular at the entry 24.

In this regard, connection means (not shown) are provided on the support structure 2 to connect the recovery device 1 directly to the textile machine or to the feed device 20.

The recovery device 1 also comprises an entry 3 for the yarn "F" and an exit 4.

Preferably, as illustrated, the entry 3 and the exit 4 are formed by respective eyes fixed to the support structure 2.

Alternatively, the eye of exit 4 can be avoided. In this case, the yarn "F" exiting the recovery device 1 is guided by the entry 24 of the feed device 20.

The yarn "F" entering through the entry eye 3 comes from the bobbin, while the yarn "F" exiting the exit eye 4 enters, through the entry 24, the feed device 20.

The yarn "F", between the entry eye 3 and the exit eye 4, follows a predetermined path.

The recovery device 1 also comprises a drum 5 rotatably associated with the support structure 2. The drum 5 is operationally arranged between the entry eye 3 and the exit eye 4. In other words, the yarn "F" intercepts the drum 5 along its path.

The drum 5 is connected to a drive 15, such as a motor or constant force spring, in such a way so that it can be rotated.

The drum 5 has a substantially cylindrical side wall 6 which extends from the support structure 2. A circular crown 7 is fixed to the side wall 6 at an end opposite to the support structure 2.

As illustrated, the drum 5 of the recovery device 1 has a diameter substantially equal to drum 21 of the feed device 20.

The circular crown 7 protrudes from the side wall 6 away from an axis of rotation "A" of the drum 5.

The circular crown 7 forms an edge (8) of the drum 5.

The drum 5 has a seat 9 that houses the yarn "F" as it passes from the entry eye 3 to the exit eye 4. The seat 9 is, therefore, operationally located between the entry eye 3 and the exit eye 4.

The seat is made on the edge 8 of the drum 5. In detail, the seat 9 is made on the circular crown 7 of the drum 5. In this regard, a ceramic element 10 is fixed to the edge 8 of the drum 5. The ceramic element 10 is preferably a ring. More precisely, the ceramic element 10 is fixed at the circular crown 7. The ceramic element 10 is passed through, during use, by the yarn "F" and forms the seat 9.

In an embodiment not shown, the ceramic element 10 is composed of a grooved guide, made of a ceramic or other material, open and serrated, allowing the yarn "F" to hook onto or off said ceramic element completely independently depending on the operating phases.

According to the present invention, the drum 5 is switchable between a deactivated configuration and an activated configuration.

In the deactivated configuration, the seat 9 is substantially aligned with the entry eye 3 and the exit eye 4.

Note that, as illustrated, the predetermined, and undiverted, path of the yarn "F" in this configuration between the entry eye 3 and the exit eye 4 is not strictly straight, but represented by a jagged line of straight segments between the entry eye 3 and the seat 9 and between the seat 9 and the exit eye 4.

Figure 4:
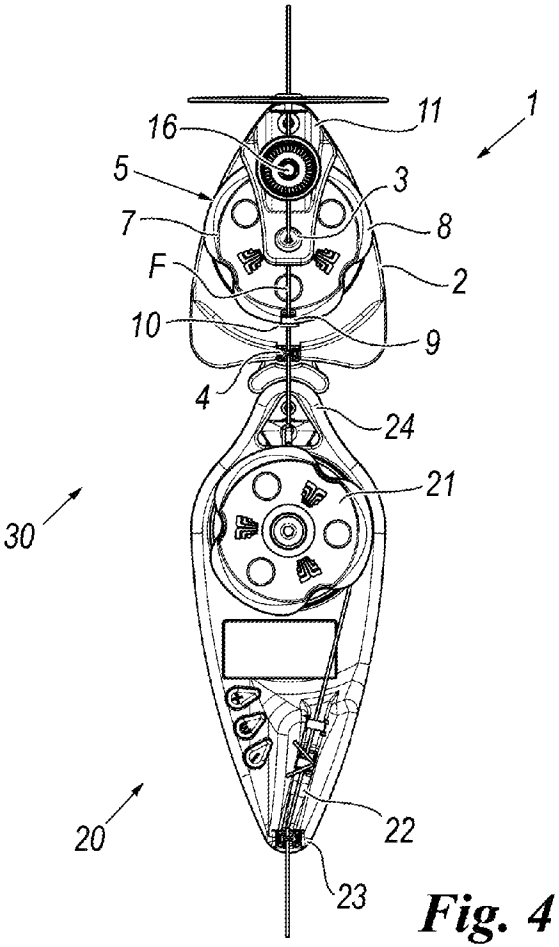
FIG. 4 is a front view of the yarn recovery device and feed system in the configuration shown in FIG. 1.
Figure 3:
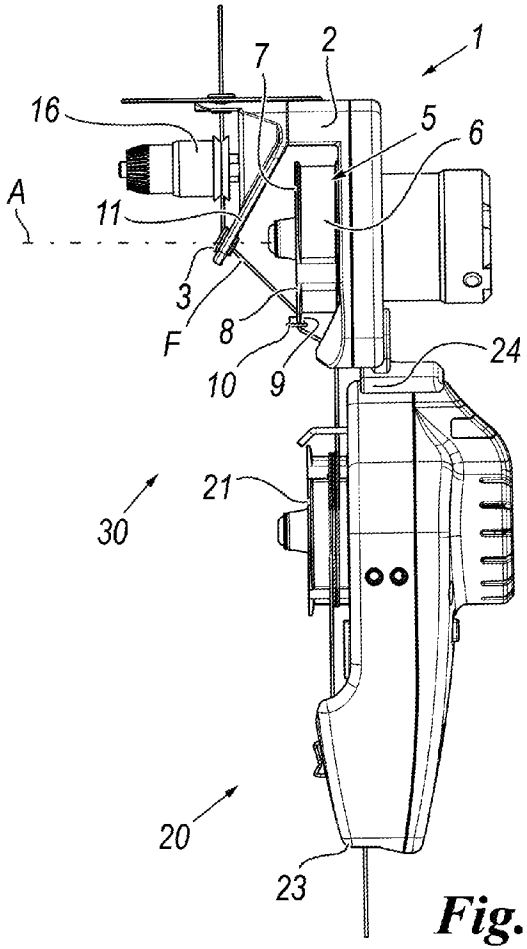
FIG. 3 is a side view of the yarn recovery device and feed system in the configuration shown in FIG. 1.
Figure 6:
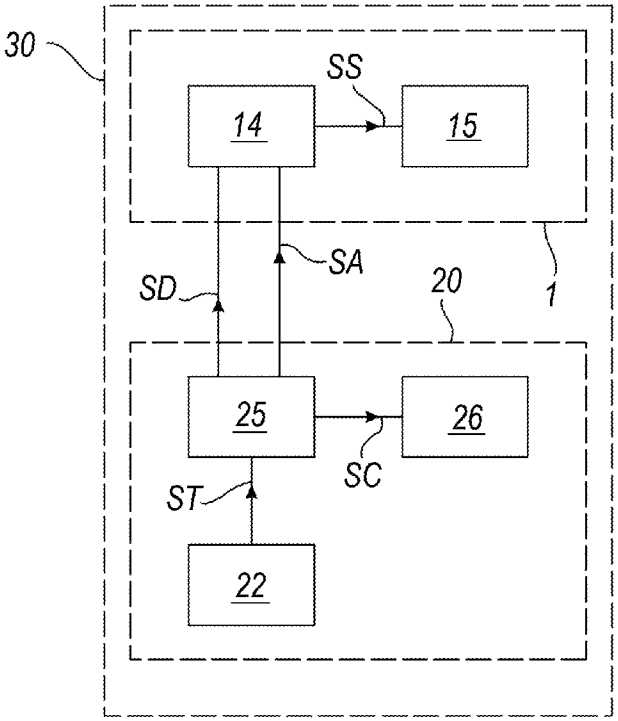
FIG. 6 is a schematic block diagram of a detail of the yarn recovery device and feed system according to the invention.

In any case, the undiverted path is aligned in a front view of the recovery device 1, as shown in FIGS. 1 and 4.

In other words, the undiverted path lies in a plane of symmetry of the recovery device 1 passing through the rotation axis "A" of the drum 5. In the deactivated configuration, the yarn "F" is not wound onto the drum 5. In the activated configuration, however, the seat 9 is substantially misaligned in relation to the entry eye 3 and the exit eye 4.

In other words, in the activated configuration the yarn "F" is diverted from its predetermined path in that the seat 9 is moved.

Figure 2:
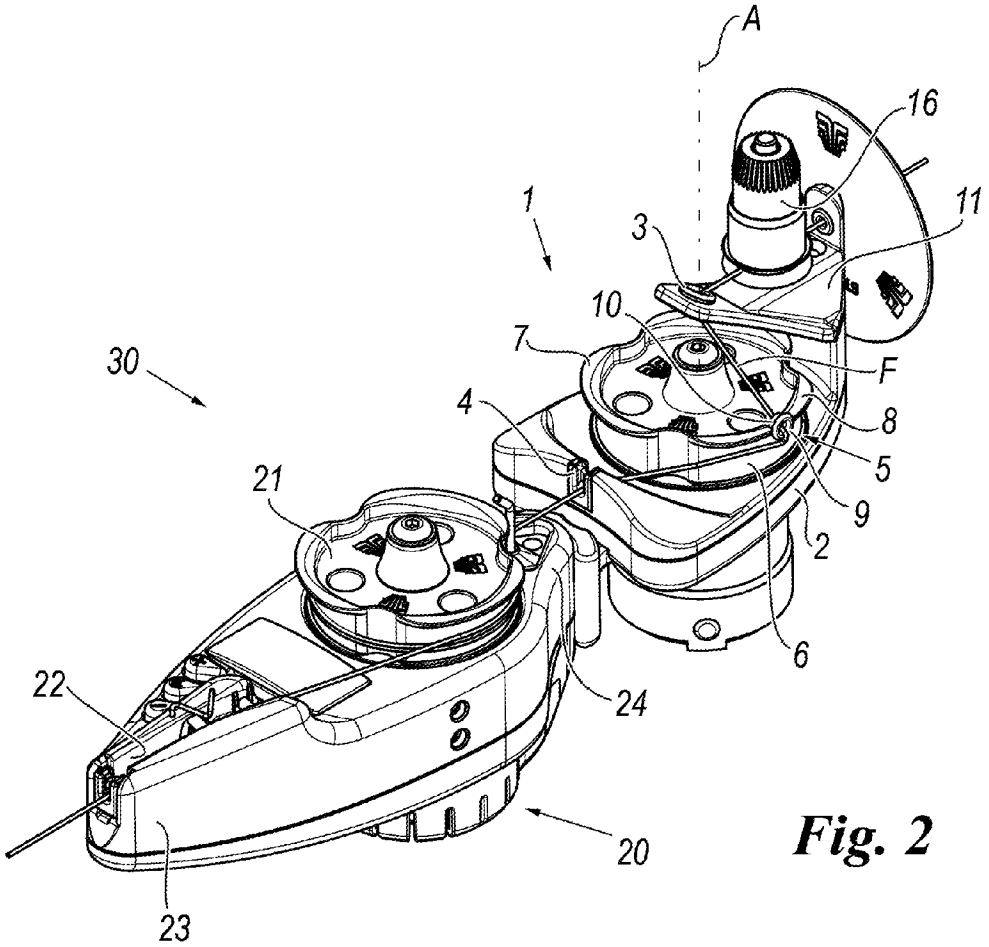
FIG. 2 is a perspective view of the yarn recovery device and feed system in FIG. 1 in a second operating configuration.
Figure 5:
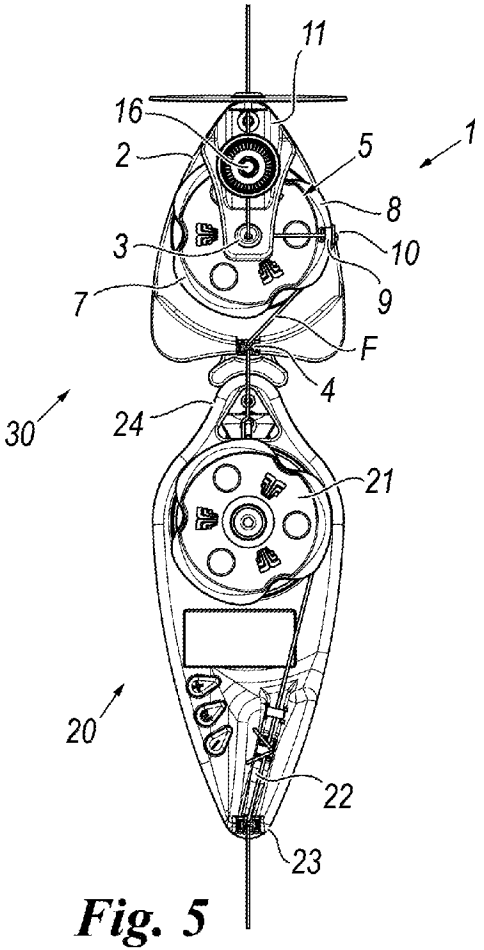
FIG. 5 is a front view of the yarn recovery device and feed system in the configuration shown in FIG. 2.

As shown in FIGS. 2 and 5, the diverted yarn "F" winds onto the drum 5 and in particular onto the side part 6 of the drum 5. Note that the portion of yarn "F" wound onto the drum 5 is that between the seat 9 and the exit eye 4. Note also that the diverted path assumed by the yarn "F" in the activated configuration of the recovery device 1 is longer than the undiverted path assumed by the yarn in the deactivated configuration of the recovery device 1. In fact, the activated configuration is set when a recovery of yarn "F" is required upstream of the feed device 20. This will emerge more clearly later on in the present description.

The switching from the deactivated configuration to the activated configuration and vice versa is achieved by rotating the drum 5 and consequently diverting the seat 9, i.e. the ceramic element 10. This rotation of the drum 5 is dictated by the motor 15.

The drum 5 and the seat 9 can perform, in principle, any number of revolutions and/or fractions of a revolution. Naturally, the higher the number of revolutions imposed on the drum 5, the greater the quantity of yarn "F" recovered.

Advantageously, the entry eye 3 is at a distance from the drum 5 so that the portion of yarn "F" between the entry eye 3 and the seat 9 is not involved in the rotation of the drum 5. In other words, the entry eye 3 is arranged at a pre-set distance from a plane defined by the rotation of the seat 9, said plane being regarded as a reference.

In fact, therefore, during the recovery phase of the yarn "F", the recovery device 1 does not take yarn from the bobbin, but only that coming from the drum 21 of the feed device 20.

The recovery device 1 also comprises a yarn brake 16 arranged upstream of the entry eye 3. This yarn brake 16 does not serve to block the recovery of yarn from the bobbin but simply has a stabilisation function. Its adjustment is not therefore critical and has no influence whatsoever on the operation of the recovery device 1.

Advantageously, the entry eye 3 is arranged substantially along the axis of rotation "A" of the drum 5.

The entry eye 3 is mounted on an appendix 11 which extends from the support structure 2.

The exit eye 4 faces the side wall 6 of the drum 5. Furthermore, the exit eye 4 is arranged opposite the entry eye 3 in relation to the plane defined by the rotation of the seat 9. In this way, the portion of yarn "F" between the seat 9 and the exit eye 4 is definitely involved in the rotation of the drum 5, being wound round its side wall 6.

The recovery device 1 comprises a control unit 14 connected to the motor 15 to control the operation thereof. Furthermore, the control unit 14 is capable of knowing at any moment the position of the drum 5 and the seat 9.

Furthermore, the control unit 14 is, in use, connected to the feed device 20 so as to co-ordinate the operation of the motor 15 of the recovery device 1 with the requirements of the feed device 20.

Interfacing between the recovery device 1 and the feed device 20, necessary for synchronisation between the two as the various operating phases of the machine vary, can occur in different ways. By way of example, it can be performed by means of a serial bus, digital inputs/outputs or analogue inputs/outputs appropriately configured.

In detail, when the drum 21 of the feed device 20 slows down or reverses its speed of rotation, the control unit receives an activation signal "SA" generated by the processing unit 25 of the feed device 20 and representative of the requirement to activate recovery. In other words, the activation signal "SA" imposes the switching of drum 5 from the deactivated configuration to the activated configuration.

When the control unit 14 receives the activation signal "SA", the control unit 14 begins to apply to the motor 15, by means of a special control signal "SS", a minimum current/torque, that may be programmable, which tends to make the drum 5 rotate in the direction that corresponds to the recovery of the yarn.

The control unit 14 thus brings the drum 5 from the deactivated configuration to the activated configuration. Obviously, since the current/torque applied to the motor 15 is very low, the rotation of the recovery drum 5 stops as soon as the necessary quantity of yarn has been recovered.

To increase the dynamics of the system 30, the current/torque applied to the motor 15 could be greater in the initial phase in order to prevent slackening of the yarn and then automatically reduce as a function of time or of the quantity of yarn recovered.

In a more advanced embodiment, the activation signal "SA" could contain not only the recovery request but also the information on the quantity/speed of the yarn "F" recovered by the feed device 20. In this case, the feed device 20 also has an encoder (not shown) associated with the drum 21, with which to measure the speed and direction of rotation of the feed drum 21.

In this embodiment, the control unit 14 controls the motor 15, again by means of the control signal "SS", associated with the drum 5 of the recovery device 1 so that its speed of rotation corresponds, according to a pre-established ratio, based also on the difference in diameter between the two drums, which could be the same or different, to the speed of rotation of the drum 21 of the feed device 20. In other words, the drum 5 of the recovery device 1 is in electrical axis with the drum 21 of the feed device 20. During the recovery of the yarn "F", the rotation of the drum 5 of the recovery device 1 is therefore perfectly synchronised with the rotation of the drum 21 of the feed device 20. Alternatively, the control signal "SS" can control the motor 15 of the drum 5 depending on the quantity yarn "F" to be recovered, as well as on the speed, by imposing a set number of revolutions on the drum 5.

In this configuration too, in order to make the system 30 more responsive and prevent slackening of the yarn, it is preferably possible to vary this speed ratio so as to recover at a higher speed during the initial phases and then subsequently slow down to the correct recovery speed.

Advantageously, the control unit 14 measures, through an encoder, possibly incorporated into the motor 5, during the presence of the activation signal "SA", the number of rotations or fractions of rotations of the drum 5 of the recovery device 1 in order to know precisely the quantity of yarn "F" actually recovered.

When the feed device 20 resumes feeding of the yarn "F" (i.e. when the drum 21 resumes rotation in the direction of feed), it sends the control unit 14 of the recovery device 1 a deactivation signal "SD" representative of the command to interrupt the recovery phase. This means that this deactivation signal "SD" imposes the interruption of the rotation of the drum 5 of the recovery device 1 and the reversal of the direction of rotation so as to return the recovered yarn, completely or partly, to the feed device 20, if there is in fact a stock of yarn on the drum 5.

In other words, the deactivation signal "SD" imposes the switching of the drum 5 from the activated configuration to the deactivated configuration.

At this point, the control unit 14 must switch the drum 5 of the recovery device 1 from the activated configuration to the deactivated configuration in order to facilitate the feed of the yarn.

Note that the maximum number of revolutions of the drum 5 when it unwinds the previously recovered yarn "F" is equal to the number of revolutions or fractions of a revolution previously performed during the recovery phase.

To bring the drum 5 of the recovery device 1 back to the deactivated configuration, the control unit 14 can, in the simplest embodiment, close a (P, PI, PID) control loop on the position of drum 5. Alternatively, the control unit 14 can apply to the motor, by means of the control signal "SS", a minimum current/torque until the initial position is reached.

In another more developed embodiment, the deactivation signal "SD" can contain not only the request to stop recovery and restart the feed but can also be representative of the quantity/speed of the yarn fed by the feed device 20. In this regard, the feed device 20 also has an encoder (not shown) by which to measure the speed and direction of rotation of the drum 21 of said feed device 20.

In this phase, the control unit 14 controls, again by means of the control signal "SS", the motor 15 associated with the drum 5 of the recovery device 1 so that its speed of rotation corresponds, in accordance with a pre-set ratio, to the speed of rotation of the drum 21 of the feed device 20.

In other words, also during the return of the previously recovered yarn "F", the drum 5 of the recovery device 1 is in electrical axis with the drum 21 of the feed device 20. In other words, the return of the previously recovered yarn "F" and the rotation of the drum 5 of the recovery device 1 are perfectly synchronised with the rotation of the drum 21 of the feed device 20.

In this case too, in order to make the system 30 more responsive, by preventing the motor 26 of the feed device from overcoming the pre-tension generated during recovery, the system 30 could vary this speed ratio in order to feed at a higher speed during the initial phases and then subsequently drop to the correct recovery speed. Obviously, once the deactivated configuration has been achieved, the drum 5 of the recovery device 1 stops feeding yarn, which will again begin to run from the bobbin of wire/yarn.

Obviously, the two phases of operation, recovering and feeding the yarn, by the device 1 can be interrupted or switched from the feed device 20 depending on the operating status of the machine or particular alarm conditions.

In an alternative embodiment (not shown), the recovery device 1 is incorporated into the feed device 20.

In another embodiment (not shown) which is not part of the present invention, the recovery device 1 is associated downstream of the feed device. In this case the feed device is of a "negative action" type.

In this embodiment, the feed device 20 comprises a fixed or rotatable drum onto which the yarn coming from a bobbin is wound. In particular, a predetermined number of coils are wound onto the drum.

The textile machine independently picks up the yarn wound round the drum by the feed device. Note that, in this case, it is not necessary for the drum to be made to rotate during the feed phase, since the yarn is unwound from the drum thanks merely to the return action of the textile machine. For this reason, this type of device is called a "negative action" feed device.

Clearly, the speed at which the yarn is wound round the drum can be different from the speed at which the yarn is unwound from the drum, the drum serving only to store the yarn.

Downstream of the drum, the feed device 20 comprises a tensioning organ which, acting on the yarn, maintains it at a pre-set tension value.

For example, the tensioning organ comprises a brake composed of a ring resting on an annular support coaxial to the drum. The yarn, on leaving the drum, is passed between the ring and the annular support. The ring is pressed to a greater or lesser extent against the annular support in order to increase or reduce respectively the force acting on the yarn, which determines the tension thereof. The ring is operated by means of an actuator, magnetic for example, controlled by the processing unit of the feed device.

A tension sensor is located downstream of the drum and measures the tension of the yarn exiting the feed device. In particular, the sensor generates a tension signal representative of the value of the measured tension and sends it to the processing unit.

The processing unit generates a braking signal representative of the value of force with which the ring is pushed against the annular support. This braking signal is generated after comparing the tension signal with a pre-set tension value.

Note that all of the signals described (for example, the activation signal "SA", the command signal "SS", the deactivation signal "SD", the tension signal and the braking signal) can be transmitted in any mode suitable for the purpose, such as through serial communication of any sort and through analogue or digital interfaces.

In a first variation of this embodiment, the recovery device 1 is located between the drum and the tension sensor.

In this case, the processing unit of the feed device is connected to the control unit of the recovery device 1 so as to synchronise its operation in accordance with the various operating phases.

In this case too, the recovery function of the yarn by the recovery device 1 occurs at the request of the feed device 20. But, unlike the solution previously described in which the feed device 20 used the direction of rotation of the motor to control and synchronise the recovery device 1, in this case the electronic control unit of the feed device must use other information to synchronise the recovery device.

The processing unit of the feed device must therefore use the information relating to the tension measured by the tension sensor and to the quantity of yarn fed (LFA, i.e. Longueur de Fil Absorbée, Absorbed yarn length per course) to decide when to activate the recovery function of the recovery device 1. In practice, the processing unit of the feed device, realising that the request for yarn by the machine has stopped and detecting that the measured tension is less than the set tension, activates the recovery phase of the yarn by the recovery device 1.

The processing unit then generates the activation signal to activate the drum of the recovery device 1 on the basis of the tension signal and/or the braking signal. The activation signal behaves in the same way as in the above-described embodiment.

Furthermore, the processing unit stops this recovery, i.e. it sends the deactivation signal as soon as the measured tension reaches the pre-set tension value or exceeds it by a fraction.

Advantageously, the processing unit of the feed device, to prevent possible slackening of the yarn between the recovery device 1 and the textile machine, could anticipate the request for yarn recovery, by studying the derivative of the LFA yarn request speed by the textile machine and/or the tension trend.

Advantageously, the processing unit of the feed device can also use the information relating to the control of the braking device to optimise the recovery function. In fact, when the processing unit realizes that the read tension is less than the set tension and is already applying its maximum braking force, or fraction thereof, it means that, in order to keep the yarn exiting at the desired tension, it is necessary to activate the recovery function.

In a second variation of this embodiment, the recovery device 1 is located downstream of the feed device and in particular downstream of its tension sensor.

In this case, the recovery device 1 has its own tension sensor associated with the control unit. This sensor measures the tension of the yarn exiting the recovery device 1 and generates its own tension signal representative of the measured tension value.

Obviously, in this case the recovery device 1 knows the programmed tension value and works completely independently, simply synchronised with the tension sensor at the exit of the recovery device 1.

In this case, the recovery device 1 could be completely independent in relation to the feed device 20, or use the tension information in combination with the braking status of the feed device 20. Thus, the recovery device 1 can operate on the basis of information that does not come from the feed device 20, but exclusively from the tension sensor.

Obviously, in all of the embodiments described so far, through the interface, the processing unit 25 of the feed device 20 and the control unit 14 of the recovery device 1, other information can be exchanged (alarm conditions, work status, etc.) in addition to the deactivation signal "SD" and the activation signal "SA".

Note that the type of motor 15 used to perform the recovery in the recovery device 1 is totally irrelevant. In fact, any type of motor can easily perform this task. In a simplified embodiment, the drum 5 of the recovery device 1 could be moved by a spring rather than a motor, preferably a constant-force spring.

Obviously, in this case, the recovery device 1, very similar to the other known solutions but smaller, would enable an unlimited amount of yarn to be recovered and no brake upstream would be required to prevent the yarn from being recovered from the bobbin thanks to the geometry of its construction.

In other embodiments, the recovery device 1 can be associated with devices to feed the yarn "F" that differ from those so far described (for example storage feeders with no tension sensor at the exit).

Furthermore, the recovery device 1 can be mechanically fixed to the feed device 20, or be mechanically independent and located at some distance therefrom.

As stated above, this invention also relates to the system 30 for feeding the yarn "F", which comprises the recovery device 1 and the feed device 20 connected operationally and/or structurally to the recovery device 1.

Note that the recovery device 1 is operationally connected solely to the feed device 20. In other words, the recovery device 1 is not directly connected to the textile machine to which the feed device 20 feeds the yarn "F".

The invention achieves the proposed aim.

In fact, the recovery device according to the present invention enables a more efficient recovery of the yarn "F" upstream, in particular without stressing the incoming yard (pre-tension) and without limiting the dynamics of the system as a whole.

The use of the rotating drum having a seat that is also rotatable, allows the yarn "F" to be diverted quickly and safely, without any risk of creating knots or over-tensioning the recovered yarn "F".

In particular, the recovery device described allows the yarn to be fed to the textile machine at the most suitable tension depending on the different operating phases of the textile machine.

The invention claimed is:

1. A yarn feed system comprising:

a device to feed yarn and a yarn recovery device, the yarn recovery device comprising:

a support structure that can be associated with the yarn feed device;

said recovery device having a yarn entry and yarn exit associated with said support structure;

a drum rotatably associated with the support structure having a seat to accommodate the yarn operationally located between said yarn entry and said yarn exit;

said drum being switchable between a deactivated configuration, in which said seat is substantially aligned with said yarn entry and said yarn exit to allow the free passage of the yarn from or towards said feed device, and an activated configuration, in which the seat is misaligned in relation to said yarn entry and said yarn exit to partly wind the yarn onto said drum, wherein the recovery device is associated upstream of said feed device.

2. The system according to claim 1, comprising a motor associated with said recovery device drum and activated to rotate said drum from the deactivated to the activated configuration and vice versa.

3. The system according to claim 1, wherein said seat is made on an edge of said recovery device drum.

4. The system according to claim 3, wherein the recovery device comprises a ring fixed to said edge of said drum, said ring and said seat.

5. The system according to claim 4, wherein said recovery drum comprises a side wall projecting from said support structure and a circular crown fixed to an end of said drum opposite the support structure and forming said edge, said ring being fixed at said circular crown.

6. The system according to claim 1, wherein said entry is formed by an eye arranged at a pre-set distance from a plane defined by the rotation of said seat.

7. The system according to claim 1, also comprising a control unit connected to said feed device and connected to said motor of said recovery device, said control unit being capable of receiving an activation signal (SA) coming from said feed device and representative of the start of the activated configuration and capable of generating a control signal (SS) sent to said motor to rotate said drum to wind said yarn.

8. The system according to claim 7, wherein said control unit is also capable of receiving a deactivation signal (SD) coming from said feed device and representative of the stopping of the activated configuration and of generating said control signal (SS) sent to said motor to rotate said drum to unwind said yarn.

9. The system according to claim 1, comprising a spring, associated with said recovery device drum that can be activated to rotate said recovery device drum from the deactivated to the activated configuration and vice versa.

10. The system according to claim 1, wherein the drum of the recovery device is in electrical synchronization with a drum of the feed device during a recovery and/or release phase of the yarn (F).

11. The system according to claim 1, wherein the recovery device is incorporated into the feed device.

12. The system according to claim 1, wherein the recovering device drum and said seat are suitable to perform any number of revolutions and/or fractions of a revolution, the higher the number of revolutions imposed on the recovery device drum, the greater the quantity of yarn recovered.

13. The system according to claim 1, wherein the yarn feed device is for feeding yarn at a constant tension.

14. The system according to claim 1, comprising a constant-force spring associated with said recovery device drum that can be activated to rotate said recovery device drum from the deactivated to the activated configuration and vice versa.

15. The system according to claim 1, wherein the recovery device is incorporated into the feed device upstream of a tension sensor of said feed device.

* * * * *